United States Patent [19]

Kervinio et al.

[11] 4,385,009

[45] May 24, 1983

[54] AUTOMATIC STARTER DEVICE FOR A DOUBLE BARREL CARBURATOR

[75] Inventors: Jean-Pierre Kervinio, Mennecy; André Nartowski, Marly le Roi, both of France

[73] Assignee: Regie Nationale des Usines Renault, Boulogne-Billancourt, France

[21] Appl. No.: 316,449

[22] Filed: Oct. 20, 1981

[30] Foreign Application Priority Data

Nov. 7, 1980 [FR] France ..... 80 23851

[51] Int. Cl.[3] ..... F02M 1/10

[52] U.S. Cl. ..... 261/23 A; 261/39 B

[58] Field of Search ..... 261/23 A, 39 B

[56] References Cited

U.S. PATENT DOCUMENTS

| | | | |
|---|---|---|---|
| 2,609,806 | 9/1952 | Winkler | 261/23 A |
| 3,294,374 | 12/1966 | Smith et al. . | |
| 3,785,624 | 1/1974 | Marcee . | |
| 3,831,567 | 8/1974 | Frimuth . | |
| 3,943,907 | 3/1976 | Kluth . | |
| 3,947,531 | 3/1976 | Branigin . | |
| 4,053,542 | 10/1977 | Niebrzydoski | 261/23 A |
| 4,060,062 | 11/1977 | Tsutsui et al. | 261/23 A |

FOREIGN PATENT DOCUMENTS

| | | | |
|---|---|---|---|
| 2446403 | 4/1976 | Fed. Rep. of Germany . | |
| 2617728 | 5/1977 | Fed. Rep. of Germany | 261/23 A |
| 1225320 | 6/1960 | France . | |
| 1291578 | 9/1962 | France . | |
| 2296102 | 11/1975 | France . | |

*Primary Examiner*—Tim R. Miles

*Attorney, Agent, or Firm*—Oblon, Fisher, Spivak, McClelland & Maier

[57] ABSTRACT

The invention relates to an automatic choke device for carburators having at least two barrels. The device consists of a control element for the valves choke of all the barrels of the carburator that work together with a control element of the butterfly of the second barrel of the carburator, each element being activated by a related action of a thermally sensitive element and of a pressure gradient which is applied at the outlet of a vacuum collector by means of a pneumatic organ.

5 Claims, 6 Drawing Figures

AUTOMATIC STARTER DEVICE FOR A DOUBLE BARREL CARBURATOR

BACKGROUND OF THE INVENTION

1. Field of the Invention

The present invention is in the field of carburators for internal combustion motors, and relates more specifically to an automatic choke device designed to be incorporated into a carburator, particularly a two barrel carburator.

2. Description of the Prior Art

Automatic chokes of the bimetallic activation type mounted on the carburator are designed to carry out two functions simultaneously, namely to feed the motor when starting to assure a given idle speed and to enrich the mixture so as to allow cold weather starting of the vehicle until the motor reaches a given temperature, for example in the order of 80° C. These two functions have been made possible by a single mechanism. It is very difficult to accomplish a satisfactory adaptation of the mixture richness for running during transient conditions, said richness then being too high for steady speed conditions and for idling, which translates into a too elevated mixture range when stopping.

SUMMARY OF THE INVENTION

The present invention has as its object the elimination of both of these problems by furnishing an automatic choke device adaptable to carburators with two or four barrels which also presents the other advantages of:

1. being 100% automatic without needing to be engaged before operating;
2. decreasing the motor r.p.m.'s after starting, immediately and automatically;
3. overcoming these problems while meeting the antipollution standards and providing minimum fuel consumption at slow speeds, the richness being regulated for the first barrel of the carburator and so weak that the output of gasoline when cold is insufficient to start the motor (making it necessary in the prior art to use either electromagnetic auxiliary jets or special enrichers controlled by the temperature), these inconveniences being overcome in the invention due to the fact that the choke device according to the invention allows motor starting with the aid of the second carburator barrel;
4. making it possible to eliminate the actuation of the choke valve after the motor has started to run at idle and when loaded, so that the vehicle speed is stabilized, which translates into fuel savings;
5. eliminating the actuation of the choke valve very rapidly while retaining the positive opening of the second barrel for the proper amount of time to release enrichment at the moment of equilibrium; for example, if the motor hasn't attained normal temperature, and
6. solving the problems associated with cold starting and motor idling related to its loaded operation.

The automatic choke device for a carburator consisting of at least two barrels according to the present invention is characterized by the fact that it consists of means for controlling the valves of the barrels of the carburator which cooperate with a butterfly control means of the second barrel of the carburator, each means being activated by the conjugated action of a thermally sensitive element and of a pressure gradient which is applied at the output of a vacuum collector by way of a pneumatic organ.

The automatic starter choke according to the invention is otherwise characterized by the following points:

1. the choke valve control means is composed of a rotating lever articulated to one extremity of a tie rod whose other extremity is solidly connected to the membrane of a first pneumatic organ;
2. the control means of the butterfly valve of the second carburator barrel are comprised of a cam whose angular displacement is controlled by a second thermally sensitive organ of the bi-metallic type whose displacement is a function of the temperature of the motor, said cam being designed to make contact with an adjustable stop affixed to the extremity of a lever whose other extremity is solidly connected to a control rod, the latter being articulated at one of its extremities with a lever solidly connected to the axle of the butterfly valve, while the other extremity is solidly connected to the membrane of a second pneumatic organ;
3. the first and second pneumatic organs are manometric capsules whose compartment that is traversed by the control rod is at atmospheric pressure while the other, containing the return springs of the respective membranes, is connected by a flexible conduit to the intake manifold, the stop elements being mounted respectively on the capsules;
4. the delay means of the vacuum feed line are mounted between the manometric capsule and the intake manifold.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

Figure 1:
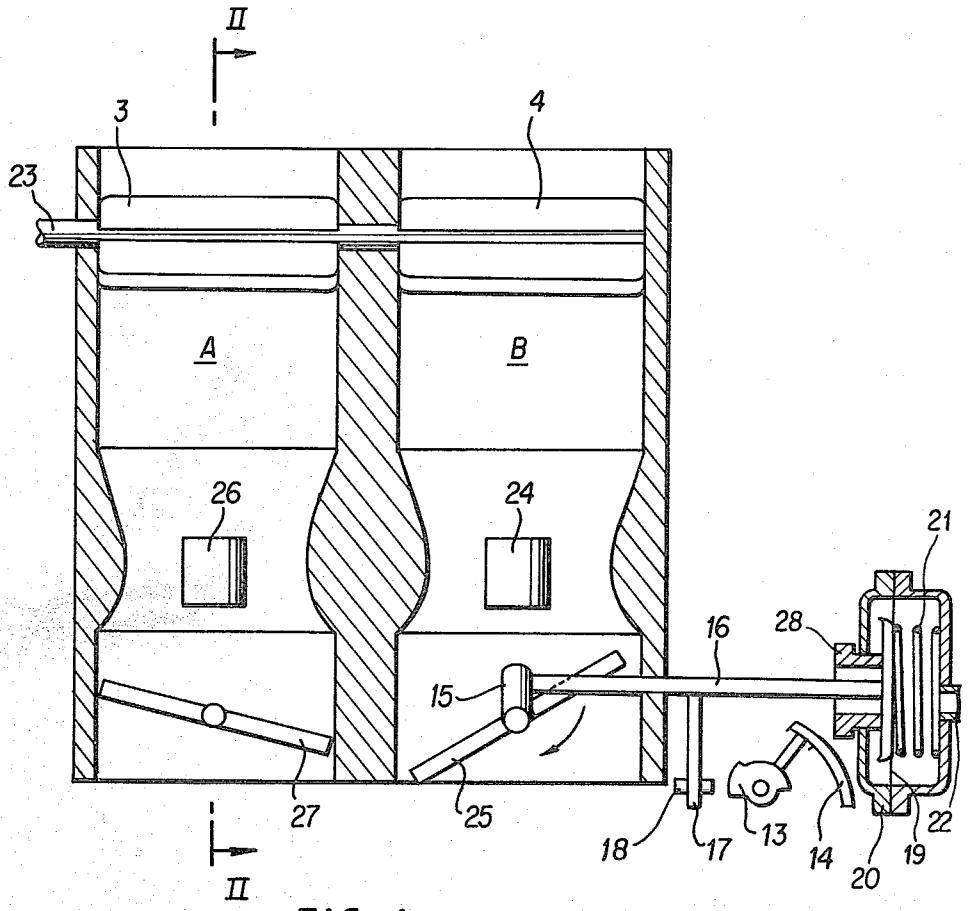
FIG. 1 is a cross sectional view of the choke device according to the invention, applied to a two barrel carburator.

The carburator on which the automatic shoke device according to the present invention is mounted comprises two barrels A and B. The butterfly control mechanism, which is not the object of the invention, is not shown in the drawing.

The automatic starter choke according to the invention consists of two elements one of which is mounted on the first barrel A of the carburator and the other of which is mounted on the second barrel B.

The element mounted on barrel A is constructed to regulate the opening of valves 3 and 4. The element is composed of a rotating lever 1 whose position is determined by a thermally sensitive element 2 of the bimetallic type whose displacement is a function of the motor temperature. Lever 1 is connected to axle 23 of valves 3 and 4 by a tie rod 5; the tie rod is articulated to a control rod 5*a* which is solidly attached to said axle 23. In addition, lever 1 is directly connected by means of a slot 7 to the lower extremity of a rod 6 which is solidly connected to its opposite extremity to the membrane 8 of a manometric capsule 9, containing within its upper chamber a spring 10 designed to exert a given force on membrane 8. A regulator in the form of a stop 11 is mounted inside the manometric capsule 9, whose upper chamber communicates with the intake manifold by a flexible conduit. Pressure retarding means, for example in the form of a regulating unit 12, are disposed between the manometric capsule 9 and the intake manifold. The above arrangement makes it possible to obtain the necessary mixture richness for all motor functioning ranges, as will be disclosed in the following.

The second element, affixed to the second barrel B of the carburator, assures the necessary volume of air to start the motor and to run at idle, by acting on the butterfly. This second element includes a cam 13 whose angular position is controlled by a thermally sensitive element 14 whose displacement is controlled as a function of the motor temperature. This cam 13 is designed to limit complete closure of butterfly 25 of the second barrel B of the carburator by means of a push rod 16, articulated at one of its extremities to lever 15 which is solidly attached to the axle of butterfly 25. A lever 17 is solidly attached to this push rod 16, to whose one extremity is attached an adjustable stop 18 designed to come in contact with the cam 13. The other extremity of push rod 16 is connected to membrane 19 of a manometric capsule 20 whose chamber at the side of rod 16 is maintained at atmospheric pressure while the other chamber, in which a spring 21 is mounted to apply a force on membrane 19 and to control the opening of butterfly 25, communicates, by way of a projection 22 and a flexible conduit, with the intake manifold. An adjustment stop 28 is disposed within the portion of the unit at atmospheric pressure. The diffusers 26 and 24 are shown respectively in the barrels A and B of the carburator.

Figure 2:
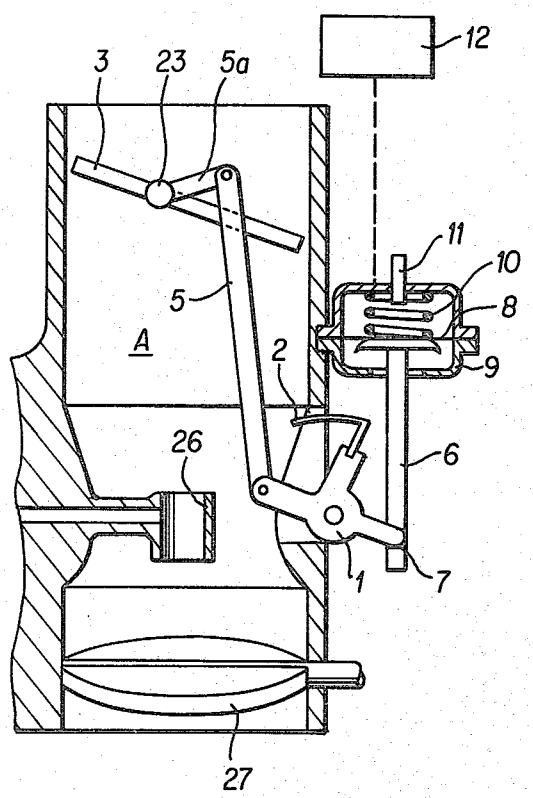
FIG. 2 is a partial cutaway view along the line II—II in FIG. 1.

The automatic choke device according to the invention functions in the following manner: After activating the starter motor, the positions of the constituant elements of the choke are shown in FIGS. 1 and 2.

The spring 21 pushes lever 15 via rod 16 and causes a certain opening of butterfly 25 of the second barrel B. The amount of this opening is controlled by an adjustable stop 28. This amount is established when the choke is calibrated.

In this position, spring 21 has only to overcome the force of the return spring of the second barrel butterfly.

On the first barrel A, the bimetallic sensor 2, via lever 1 and tie rod 5, connects to the axle 23 of valves 3 and 4 and closes the valves in the first and second barrels A and B.

As soon as the motor is turned by the starter, the motor vacuum is transferred to the region below valve 4 of the second barrel B so as to cause the discharge of gas from the diffuser 24 of the second barrel B. However, the diffuser 26 of the first barrel A does not discharge gasoline because the butterfly 27 is closed. The motor vacuum due to the starter is so weak that it is unable to move membranes 8 and 19.

As soon as the motor has started, the vacuum increases and affects membrane 19 which compresses spring 21 and pulls lever 16 to the right until stop 18 makes contact with cam 13. The butterfly 25 of the second barrel B thus turns in the direction of the arrow and reduces the passage of air. The speed of the motor falls automatically.

During this phase, the increased motor vacuum acts on membrane 8. The rate of increase in said vacuum which acts on the membrane is delayed by the regulating unit 12.

Figure 3:
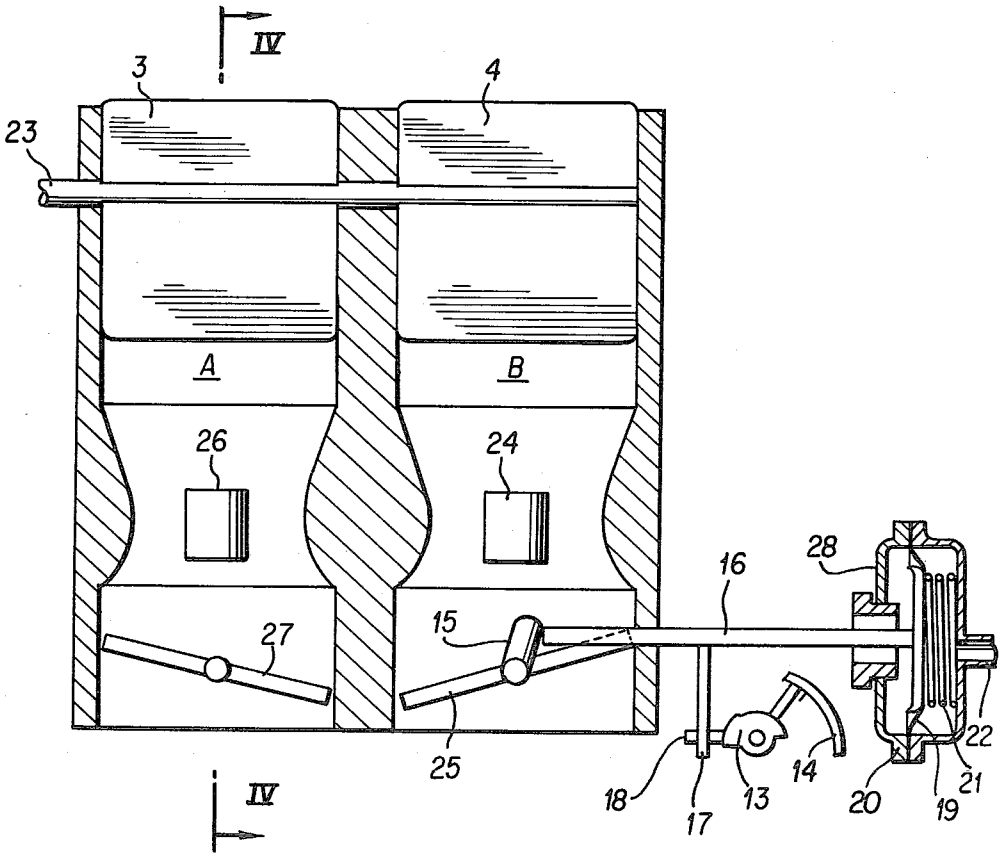
FIG. 3 is a cross sectional view, similar to FIG. 2, however showing a first stage in the function of the automatic choke.
Figure 4:
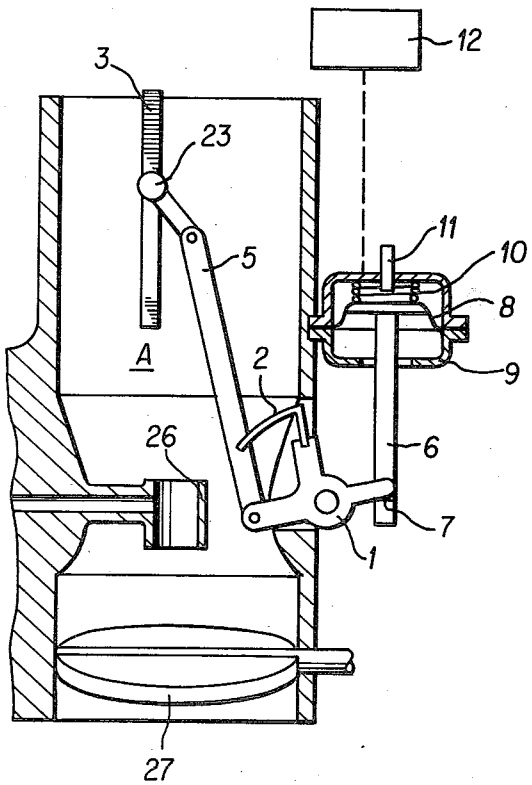
FIG. 4 is a partial cutaway view along line IV—IV of FIG. 3.

Membrane 8 is contacted by a spring 10, and the vacuum moves the membrane in opposition to the spring so that rod 6 turns lever 1 which, consequently, opens valves 3 and 4. This system position is represented in FIGS. 3 and 4.

The motor is supplied with fuel in this position by circuits in the first and second barrels. These circuits are not shown in the drawings. If the quantity of fuel is not sufficient, one may augment it by changing the jets in the second barrel, without increasing fuel consumption during warm running.

Figure 5:
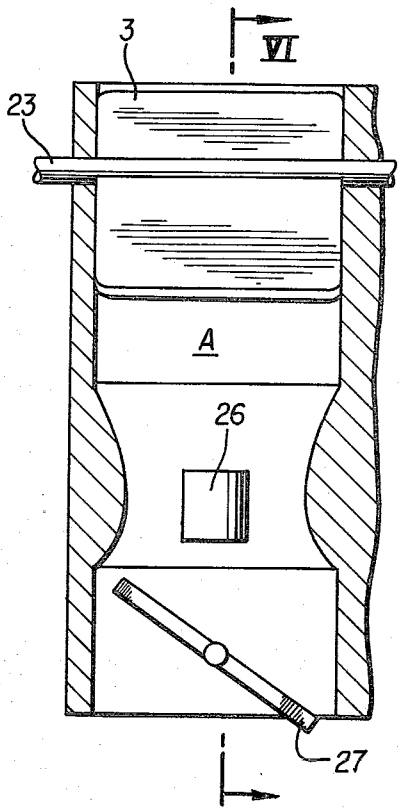
FIG. 5 is a partial cutaway view of a first barrel of the carburator, showing a second stage in the function of the automatic choke.
Figure 6:
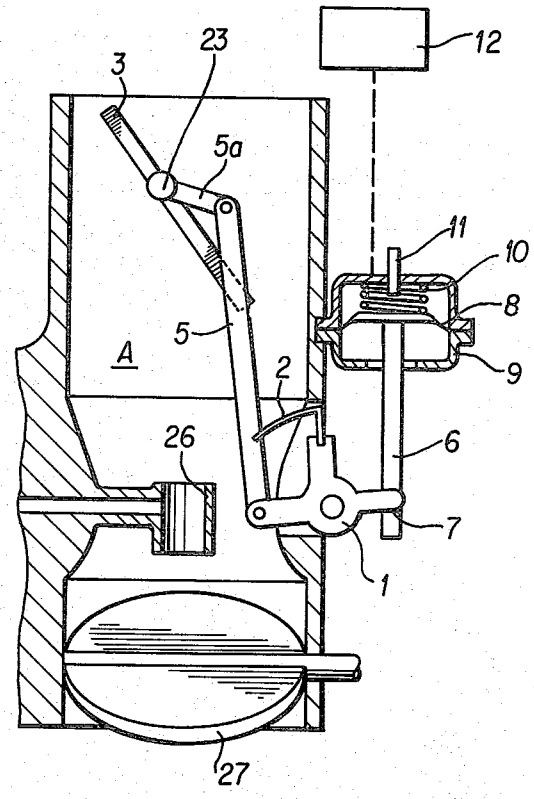
FIG. 6 is an axial cross sectional view along line VI—VI of FIG. 5.

FIGS. 5 and 6 show the constituent elements of the automatic choke during acceleration. During this phase the butterfly 27 of the first barrel opens as does that 25 of the second barrel if acceleration is rapid. The motor vacuum thus falls rapidly. The vacuum in the upper portion of the capsule 9 also reduces rapidly because the regulating unit 12 is designed not to operate under this circumstance. The spring 10 thus pushes bar 6, the thermal sensor 2 turns lever 1 and tie rod 5 partly closes valves 3 and 4. The vacuum below the valve 3 of the first barrel increases rapidly causing increased gasoline delivery by diffuser 26. As soon as the vehicle speed stabilizes, the motor vacuum increases and valves 3 and 4 are returned to an opened position relative to element 2.

The second barrel B with its constituent elements is not shown in FIGS. 5 and 6, because during this phase the second barrel plays no role.

If total opening of valves 3 and 4 is too great to allow the vehicle to function well, it can be limited by stop 11.

As soon as the motor reaches normal warm running temperature, the thermal sensor 2 holds valves 3 and 4 in the open position and thermal sensor 14 turns cam 13. Consequently, the rod 16 assumes a position in which the butterfly 25 of the second barrel is completely closed. To obtain this position, it is necessary to calibrate spring 21 and the return spring of the second barrel.

For starting with the motor hot, the system mounted on the first barrel is not activated because the thermal element 2 keeps valves 3 and 4 in the open position.

In contrast, the system on the second barrel opens butterfly 25 of the second barrel B. As soon as the motor is running, the motor vacuum re-pulls the rod 16 by means of membrane 19, and butterfly 25 of the second barrel B is closed. A low idle speed is assured by the fixed position of butterfly 27 of the first barrel A.

The invention is in no way limited to the embodiment described hereinabove, it encompasses all modifications and variants within the range of experience of a person of skill in the art. Thus, one can conceive of a gasket below the butterfly of the second barrel at the place of the junction of the intake manifold or in association with the latter.

What is claimed as new and desired to be secured by Letters Patent of the United States is:

1. An automatic choke device for a carburator having at least two barrels, each said barrel including a choke valve and a butterfly valve, said carburator being mounted on an intake manifold, said choke device comprising:

first movable control means connected to the choke valves of all of said barrels;

first thermally sensitive means connected to said first movable control means for actuating said first control means;

first pressure sensitive means connected to said manifold, the output of said first pressure sensitive means being connected to said first movable control means for also actuating said first control means;

second movable control means connected to the butterfly of at least one, but not the first, of said at least two barrels;

second thermally sensitive means connected to said second movable control means for actuating said second control means;

second pressure sensitive means connected to said manifold, the output of said second pressure sensitive means being connected to said second movable control means for actuating said second control means, said second movable control means opening said butterfly valves, but not said first butterfly valve, during cold starting conditions to supply the engine with fuel for starting.

2. The device of claim 1 wherein said first movable control means comprises:

a rotatable lever;

a first control lever fixed to the rotational axis of said choke valves;

a first tie rod articulated between said first control lever and a first portion of said rotatable lever;

wherein said first thermally sensitive means comprises a first bimetallic element connected to a second portion of said rotatable lever; and wherein said first pressure sensitive element comprises a first pressure sensitive membrane fixed to a second rod which is connected with a third portion of said rotatable lever.

3. The device of claim 1 wherein said second thermally sensitive means comprises a second bimetallic element, wherein said second pressure sensitive means comprises a second pressure sensitive membrane, and wherein said second movable control means comprises:

a rotatable cam connected to said second bimetallic element for angular displacement of said cam;

a second control lever fixed to the rotational axis of the butterfly of at least one, but not the first, of said at least two barrels;

a third rod having one end fixed to said second pressure sensitive membrane and a second end articulated to said second control lever:

a third lever having one end fixed to said third rod and a second end terminating adjacent said cam; and an adjustable stop mounted on said second end of said third lever and adapted to contact said cam.

4. The device of claim 1 wherein said first and second pressure sensitive means each comprise:

a housing;

a membrane dividing said housing into first and second chambers, said first chamber being subject to atmospheric pressure and said second chamber being subject to manifold pressure;

a conduit connecting said second chamber to said intake manifold;

a spring in said second chamber;

a control rod traversing said first chamber; and a stop for limiting the deflection of said membrane.

5. The device of claim 4 including delay means in said conduit connecting said manifold with said second chamber of said first pressure sensitive means for delaying the application of manifold pressure to said second chamber of said first pressure sensitive means.

* * * * *

UNITED STATES PATENT AND TRADEMARK OFFICE

CERTIFICATE OF CORRECTION

PATENT NO. : 4,385,009

DATED : May 24, 1983

INVENTOR(S) : Jean-Pierre Kervinio et al

It is certified that error appears in the above-identified patent and that said Letters Patent is hereby corrected as shown below:

On the title page,

--[22] Filing Date: October 29, 1981 --

Signed and Sealed this

*Sixth* Day of *September 1983*

[SEAL]

*Attest:*

GERALD J. MOSSINGHOFF

*Attesting Officer*

*Commissioner of Patents and Trademarks*